US005332032A

United States Patent [19]

Beddome et al.

[11] Patent Number: 5,332,032

[45] Date of Patent: Jul. 26, 1994

[54] LAMINATED HEAT EXCHANGER WITH STACKABLE TUBE PLATES

[75] Inventors: David W. Beddome, Amherst; Gary S. Vreeland, Medina, both of N.Y.

[73] Assignee: General Motors Corporation, Detroit, Mich.

[21] Appl. No.: 134,454

[22] Filed: Oct. 12, 1993

[51] Int. Cl.[5] ..... F28D 9/00

[52] U.S. Cl. ..... 165/153; 165/78

[58] Field of Search ..... 165/153, 78, 166, 167

[56] References Cited

U.S. PATENT DOCUMENTS

| | | | |
|---|---|---|---|
| 2,782,009 | 2/1957 | Rippingille | 165/153 |
| 4,535,839 | 8/1985 | Sacca | 165/153 |
| 4,723,601 | 2/1988 | Ohara et al. | 165/166 X |
| 4,800,954 | 1/1989 | Noguchi et al. | 165/153 |
| 5,111,877 | 5/1992 | Buchanan et al. | 165/153 |
| 5,111,878 | 5/1992 | Kadle | 165/174 |
| 5,125,453 | 6/1992 | Bertrand et al. | 165/167 X |

*Primary Examiner*—Stephen M. Hepperle
*Attorney, Agent, or Firm*—Patrick M. Griffin

[57] ABSTRACT

An automotive air conditioning system evaporator of laminated construction has tube plates, which, in brazed pairs, make up the individual flow tubes, that have an additional feature to assure regular, evenly spaced stacking of the tube plates prior to final assembly. Integrally stamped cups on one end of the plates nest to hold the cup end of the plates apart a defined distance when the plates are stacked. Spacer flanges on the opposite end of the plates interfit to keep the completed tubes spaced apart sufficiently to accommodate cooling fins in the final evaporator, but, without more, do nothing to keep the flange end of the plates evenly stacked. Special projections added to the spacer flanges contact edges of the spacer flanges of consecutive plates in the stack to keep the plates evenly spaced at both ends.

3 Claims, 2 Drawing Sheets

LAMINATED HEAT EXCHANGER WITH STACKABLE TUBE PLATES

This invention relates to laminated heat exchangers in general, and specifically to such a heat exchanger with tube plates specially designed to stack more efficiently after stamping and prior to assembly.

BACKGROUND OF THE INVENTION

Automotive air conditioning system evaporators are typically laminated or plate type heat exchangers, in which generally planar, stamped aluminum tube plates are brazed together to create a plurality of flow tubes. The tube plates are brazed together in pairs in a front-to-front orientation, creating thin, flat fluid spaces. To feed fluid in and out of the tubes, integral cups are stamped into the plates, protruding from the back surfaces thereof. When the plates are brazed together, the corresponding cups in each plate align in oppositely directed pairs, and when the completed tubes are assembled to make the evaporator, the pairs of cups line up to create two manifold pipes or passages. In the completed evaporator, the back surfaces of the tube plates of each tube face one another in opposed pairs, and these must be spaced apart by a predetermined distance just sufficient to accommodate corrugated cooling fins or air centers brazed between the tubes. In some evaporator designs, there is an integral cup stamped at each end of each tube plate, creating a manifold pipe at both ends of the completed evaporator. In newer designs, it has been found more efficient to put the cups side-by-side at just one end of each plate, putting the manifold pipes side-by-side at the top end of the completed evaporator. An example of the older design may be seen in coassigned U.S. Pat. No. 4,535,839 to Sacca, and the newer design in coassigned U.S. Pat. No. 5,111,877 to Buchanan et al.

With the older design, with the cups at each end of each plate, it is a relatively simple matter to maintain the necessary cooling fin spacing. Each cup is made to protrude by half the desired fin spacing so that the abutted pairs of cups automatically create the proper spacing. With the newer design, some other structure has to be provided at the noncup end of the plates to maintain the proper fin spacing. A known means for doing so are spacer flanges stamped integrally with the opposite end of the tube plates, projecting in the same direction as the cups, which interfit and abut when the completed tubes are assembled to give the same fin spacing as the cups. One example of a spacer flange design can be seen in U.S. Pat. No. 4,800,954 to Noguchi et al, and another in the Buchanan et al patent just noted above. A problem not articulated in these two references is the necessity for stacking the tube plates evenly as they leave the stamping presses, so that they can be picked up and handled easily during the later assembly and brazing operations. The tube plates are stacked in a back to front orientation, and the cups of consecutive tube plates nest partially into one another, creating a natural stack spacing, which is significantly less than the fin spacing between the completed tubes. In order for the flange ends of the tubes to nest together at all, it is necessary that the flanges not lie exactly perpendicular to the plane of the tube plates. Instead, they are bent out a few degrees to allow each to drop down within the next as they are stacked. Still, the nesting of the flange ends of the tubes can be uneven, because, as the next plate drops down onto the prior, its flanges can slip down too far within the prior plate as the nested cups rock or tilt on each other like spherical bearings. Uneven stacking makes later picking and handling of the tube plates less efficient.

SUMMARY OF THE INVENTION

The invention provides an improved tube plate design for a side-by-side manifold cup type of laminated evaporator, which provides even plate stacking, but with no added expense in the stamping process or interference with the final assembly process.

In the preferred embodiment disclosed, the spacer flanges are stamped with additional projections which stand outwardly, below the upper edges thereof. Each projection is spaced above the plane of the tube plate by a defined distance substantially equal to the height of the flange upper edges less the desired plate stacking spacing. When the tube plates fall into the stack, back-to-front, the cups nest as described above, and the stacking projections catch on the flange upper edges, holding the flange ends of the plates at the proper stack spacing. When the completed tube plates are assembled, the stacking projections do not interfere with the interfit of the spacer flanges to maintain the proper fin spacing.

DESCRIPTION OF THE PREFERRED EMBODIMENT

These and other features and objects of the invention will appear from the following written description and from the drawings, in which.

Figure 1:
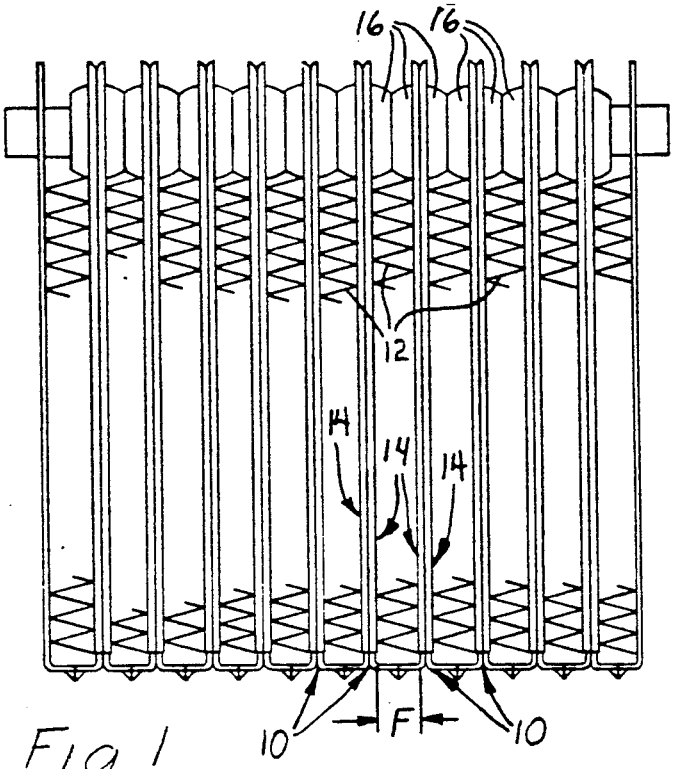
FIG. 1 is a side view of a completed evaporator.
Figure 4:
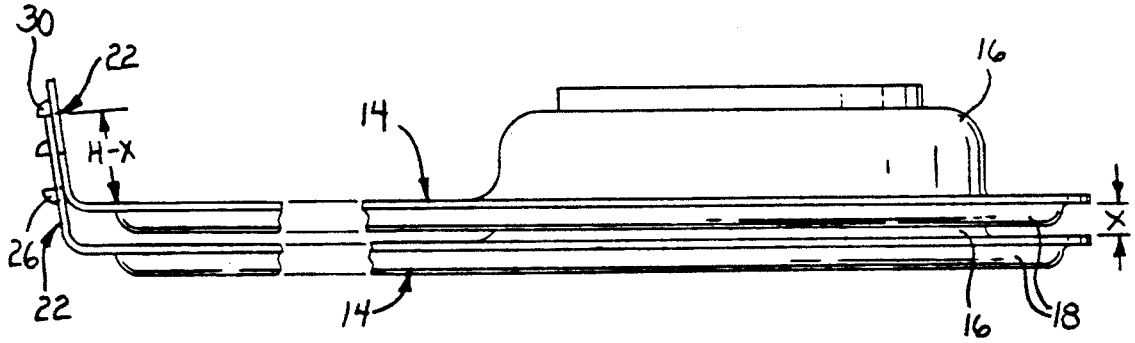
FIG. 4 is a side view of two stacked tube plates.

Referring first to FIGS. 1 and 4, a laminated type automotive air conditioning system evaporator consists of several evenly spaced flow tubes, two of which are indicated generally at (10). Between each adjacent pair of tubes (10), a corrugated cooling fin (12) is brazed in place. Consequently, a fin spacing distance "F", determined by the height of the fins (12), has to be held between adjacent tubes (10), as is described in more detail below. Each tube (10) is made up of a pair of identical tube plates, two of which are indicated generally at (14) in FIG. 4. In FIG. 4, the plates (14) are shown stacked, as they would leave the stamping press, prior to being assembled to make the tubes (10). Each tube plate (14) is a generally planar, thin stock aluminum stamping, shaped as a long, fairly narrow rectangle. Each plate (14) has an integral pair of semi-spherical open cups (16) at the top end, protruding from what may be arbitrarily termed the back. Only one cup (16) shows in a side view, since they are exactly side-by-side. A continuous, narrow perimeter ridge (18) protrudes slightly from the front, as does a bump pattern, which is hidden by ridge (18). Plates (14) stack up in a front-to-back orientation, with the cups (16) of each plate (14) nesting into the cups (16) of each consecutive plate (14) above. Because of the finite, if small, thickness of the aluminum stock from which the plates (14) are stamped, the cups (16) nest only partially together, stopping naturally when the plates (14) are a stack distance "X" apart. Because the stock thickness is small relative to the height of the fins (12), "X" will be significantly less than "F". The structures that maintain both the fin and stack spacings are described below.

Figure 2:
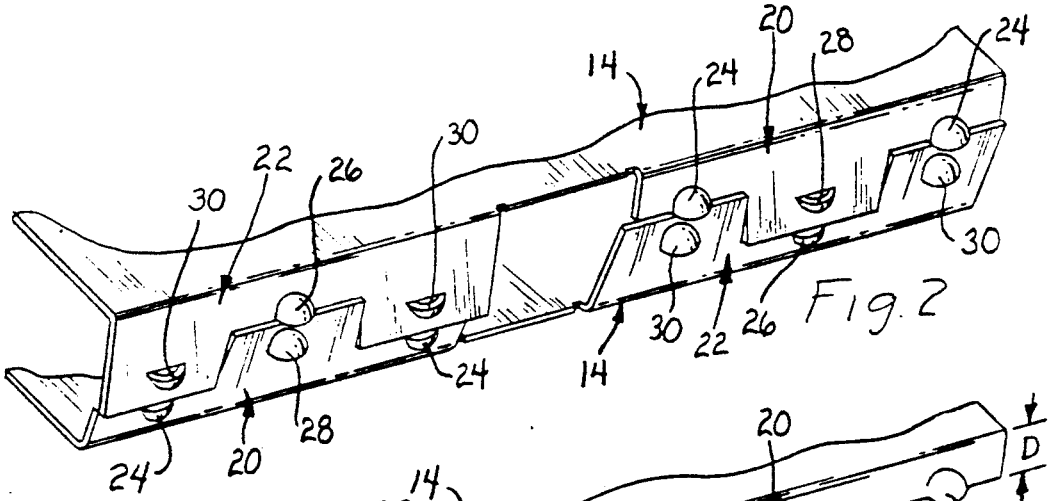
FIG. 2 is a perspective view of the lower end of two opposed tube plates from two adjacent tubes, with the spacer flanges abutted.
Figure 3:
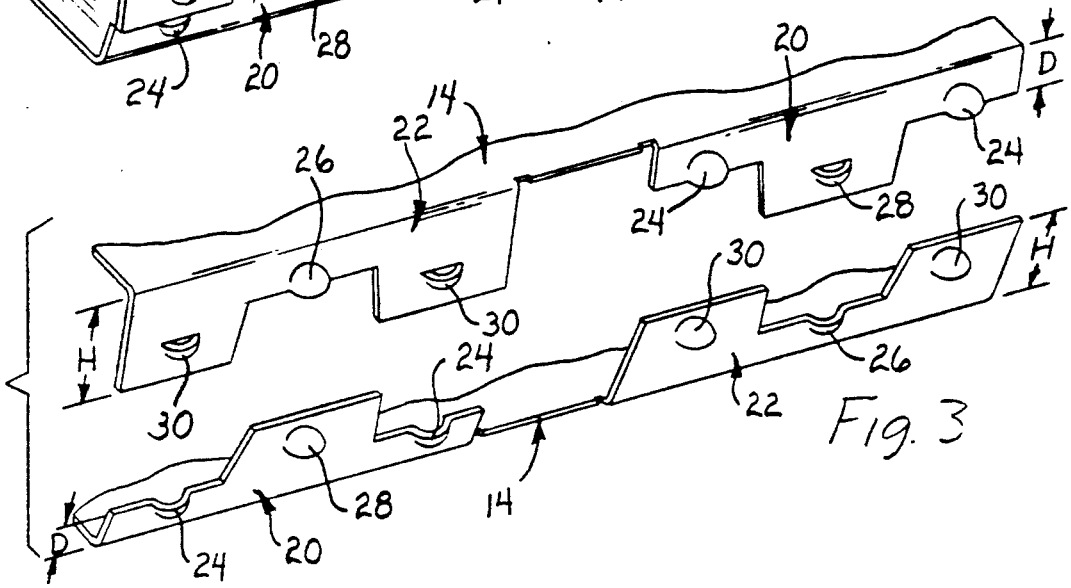
FIG. 3 is a view like FIG. 2, but with the tube plates pulled apart.

Referring next to FIGS. 2 and 3, the fin spacing between the tubes (10) is maintained by spacer flanges at the end opposite the cups (16), and projecting from the back of plate (14) in the same general direction. These may be referred to as a male flange (20), which resembles a single tooth, and a female flange (22), which resembles two teeth with a gap between. The spacer flanges (20) and (22) lie on opposite sides of the lengthwise center line of plate (14), at an angle that is slightly obtuse or bent out, rather than a straight up 90 degrees. The upper edges of the flanges (20) and (22) are spaced from the plane of plate (14) by a predetermined height "H". Given expected tolerances in the angle of the flanges (20) and (22), and the flexibility of the aluminum stock, the location of the upper edges of the flanges (20) and (22) may be expected to vary within a small tolerance range in the direction perpendicular to their height, in or out, more so than would a short, stiff feature, such as the ridge (18). Two semi-spherical "eyebrow" like projections (24) are stamped into the lower edge of either side of the male flange (20), spaced above the tube plate (14) by a distance "D" that is approximately the difference between "F" and "H". Projections (24) extend out enough to cover the expected tolerance range described above. Similarly, one projection (26) of the same size is stamped centrally into the lower edge of the female flange (22) at the same height. When two tube plates (14) are placed together front-to-front with the respective perimeter ridges (18) abutted, the spacer flanges (20) and (22) thereof extend in opposite directions, for each individual tube (10). As to adjacent tubes (10), the spacer flanges (20) and (22) extend toward one another, aligned in complementary fashion, as best seen in FIG. 3. It should be noted in FIG. 3 that just the flange end of the opposed tube plates (14) of two adjacent tubes (10) are shown. When the abutted pairs of tube plates (14) are bundled together, along with the fins (12), the respective male and female spacer flanges (20) and (22) extending out from each pair of adjacent tubes (10) interfit with one another, and the upper edges thereof contact the various fin spacing projections (24) and (26) as shown in FIG. 2. This holds the necessary fin spacing "F". Then, the whole unit is brazed together at once. The fin spacing feature just described is basically the same as that described in the Buchanan et al patent noted above. However, it should be noted here that the fin spacing projections (24) and (26) are formed on the lower edges of the flanges (20) and (22), not the upper edges, as there.

Figure 5:
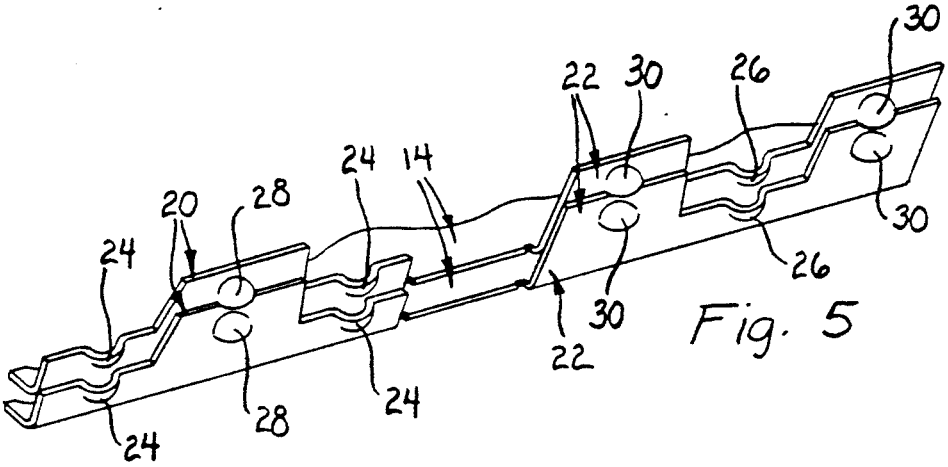
FIG. 5 is a perspective view of the flange ends of two stacked tube plates.
Figure 6:
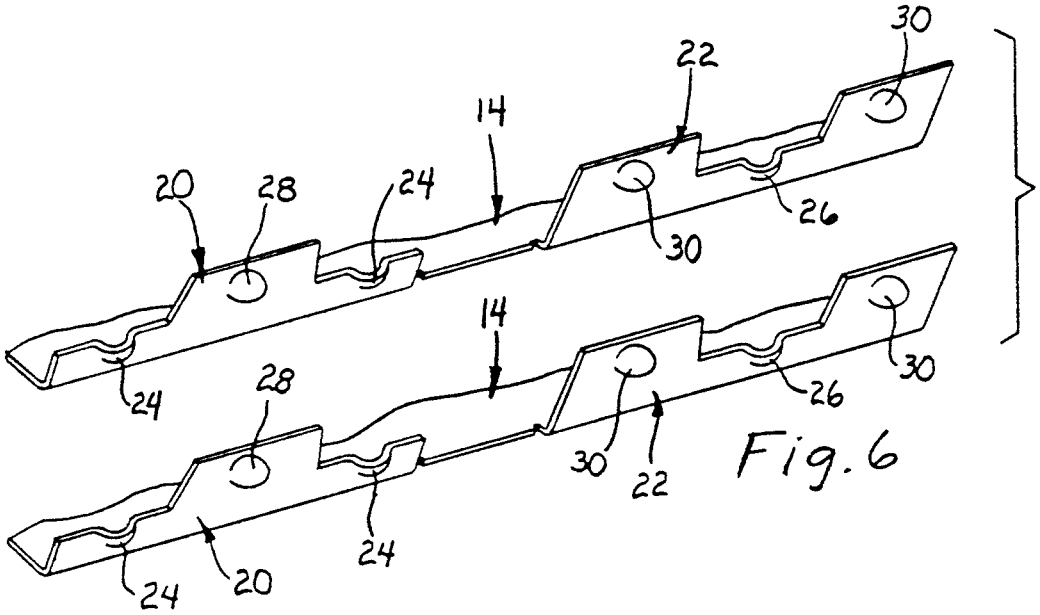
FIG. 6 is a view like FIG. 5, but showing the two tube plates spaced apart.

Referring next to FIGS. 4 through 6, it may be seen how the spacer flanges (20) and (22) are modified in the invention to secondarily provide stack spacing. Male spacer flange (20) has a stacking projection (28) stamped below it's upper edge, similar in shape to the fin spacing projections (24), but facing down, rather than up. Likewise, female spacer flange (22) has a pair of stacking projections (30) stamped below its upper edges. As best seen in FIG. 4, each stacking projection, (30) or (28), is spaced from the plane of its tube plate (14) by approximately "H−X". Only the projections (30) and (26) show in the side view of FIG. 4. The stacking projections (28) and (30) extend outwardly approximately as far as the spacing projections (24) and (26), that is, far enough to cover the expected tolerance range in the upper edges of the flanges (20) and (22). When the stamped plates (14) are ejected from the stamping press, not illustrated, and dropped consecutively into a stack, front-to-back, the spacer flanges (20) and (22) are aligned in matching fashion, rather than in complementary fashion. The cups (16) partially nest as described above, at one end, while at the other end, the stacking projections (28) and (30) catch on the upper edges of the spacer flanges (20) and (22) respectively of consecutive tube plates (14). Because of the height relations just described, both ends of the stacked plates (14) now fall securely and predictably at the "x" spacing. The stack is even, and easy to handle. To aid in that handling, the flanges (20) and (22) are spaced apart, so that a machine finger can slide between them and into the stacking space "X".

In conclusion, the spacer flanges (20) and (22) are used to provide the additional stack spacing assurance feature, while not interfering with the fin spacing feature. It is no more expensive to stamp the plates (14) as shown, and simpler to handle them thereafter. The same stack spacing could be provided with a projection or projections that had a spacing from the plane of plate (14) of approximately "X", and which extended inwardly from the spacer flanges (20) and/or (22) far enough to catch under the corner of each consecutive plate (14) in the stack. That corner is not sharp, however, so such a projection would have to be longer, and, if too long, it could potentially catch on a fin (12). Since all of the projections in the embodiment shown, the fin spacing and stack spacing projections both, extend outwardly of the spacer flanges, there is no potential interference with the fins (12). Therefore, it will be understood that it is not intended to limit the invention to just the embodiment disclosed.

The embodiments of the invention in which an exclusive property or privilege is claimed are defined as follows:

1. In a laminated heat exchanger of the type having a plurality of tubes made up of pairs generally planar tube plates with protruding integral cups at a first end and interfitting spacer flanges at the opposite end, said cups and flanges abutting at each plate end to space said tubes apart by a first predetermined distance, said integral cups partially nesting together to maintain said first plate ends spaced apart by a second, lesser predetermined distance when said tube plates are stacked prior to assembly, the improvement comprising, projections on said spacer flanges located so as to contact a portion of each consecutive stacked plate and spaced from the plane of said tube plate sufficiently to maintain said opposite ends of consecutive stacked plates spaced apart by substantially the same lesser distance.

2. In a laminated heat exchanger of the type having a plurality of tubes made up of pairs generally planar tube plates with protruding integral cups at a first end and interfitting spacer flanges at the opposite end, said cups and flanges abutting at each plate end to space said tubes apart by a first predetermined distance, said integral cups partially nesting together to maintain said first plate ends spaced apart by a second, lesser predetermined distance when said tube plates are stacked prior to assembly, the improvement comprising, projections on said spacer flanges located so as to contact a portion of the spacer flanges on each consecutive stacked plate and spaced from the plane of said tube plate sufficiently to maintain said opposite ends of consecutive stacked plates spaced apart by substantially the same lesser distance.

3. In a laminated heat exchanger of the type having a plurality of tubes made up of pairs generally planar tube plates with protruding integral cups at a first end and interfitting spacer flanges at the opposite end having upper edges of a predetermined height, said cups and flange edges abutting at each plate end to space said tubes apart by a first predetermined distance, said integral cups partially nesting together to maintain said first plate ends spaced apart by a second, lesser predetermined distance when said tube plates are stacked prior to assembly, the improvement comprising, projections on said spacer flanges spaced from the plane of said tube plate by approximately the difference between said predetermined height and said second, lesser distance so as to contact the spacer flange upper edges of each consecutive stacked plate and thereby maintain said opposite ends of consecutive stacked plates spaced apart by substantially said second distance.

* * * * *